US009945208B2

(12) United States Patent
Tolman et al.

(10) Patent No.: US 9,945,208 B2
(45) Date of Patent: Apr. 17, 2018

(54) FLOW CONTROL ASSEMBLIES FOR DOWNHOLE OPERATIONS AND SYSTEMS AND METHODS INCLUDING THE SAME

(71) Applicants: Randy C. Tolman, Spring, TX (US); Timothy G. Benish, Conroe, TX (US); Geoffrey F. Steiner, Castle Rock, CO (US)

(72) Inventors: Randy C. Tolman, Spring, TX (US); Timothy G. Benish, Conroe, TX (US); Geoffrey F. Steiner, Castle Rock, CO (US)

(73) Assignee: ExxonMobil Upstream Research Company, Spring, TX (US)

( * ) Notice: Subject to any disclaimer, the term of this patent is extended or adjusted under 35 U.S.C. 154(b) by 350 days.

(21) Appl. No.: 14/437,159

(22) PCT Filed: Nov. 18, 2013

(86) PCT No.: PCT/US2013/070605

§ 371 (c)(1),
(2) Date: Apr. 20, 2015

(87) PCT Pub. No.: WO2014/099206

PCT Pub. Date: Jun. 26, 2014

(65) Prior Publication Data

US 2015/0285030 A1 Oct. 8, 2015

Related U.S. Application Data

(60) Provisional application No. 61/834,296, filed on Jun. 12, 2013, provisional application No. 61/745,136, filed on Dec. 21, 2012.

(51) Int. Cl.
*E21B 34/14* (2006.01)
*E21B 34/12* (2006.01)
(Continued)

(52) U.S. Cl.
CPC ..... *E21B 34/12* (2013.01); *E21B 43/12* (2013.01); *E21B 2034/007* (2013.01)

(58) Field of Classification Search
CPC ..... E21B 34/14; E21B 43/26; E21B 21/103
See application file for complete search history.

(56) References Cited

U.S. PATENT DOCUMENTS 5,234,055 A 8/1993 Cornette
5,499,687 A * 3/1996 Lee ..... E21B 21/003 166/154

(Continued)

OTHER PUBLICATIONS

Schlumberger Limited, "Falcon Hydraulic-Actuated Frac Valve," 2012, http://www.slb.com/resources/other_resources/product_sheets/completions/multistage_stimulation/hydraulic_actuated_frac_valve_ps.aspx.

*Primary Examiner* — Kipp C Wallace
(74) *Attorney, Agent, or Firm* — ExxonMobil Upstream Research Company—Law Department

(57) ABSTRACT

Flow control assemblies comprise a housing that includes a housing body that defines a housing conduit, an injection conduit that extends through the housing body, and a ball sealer seat. The ball sealer seat defines a portion of the injection conduit, is defined on an inner surface of the housing, and is sized to receive a ball sealer to restrict fluid flow from the casing conduit through the injection conduit. The flow control assemblies further include a sliding sleeve that is located within the housing conduit and defines an isolation ball seat. The flow control assemblies also include a retention structure that is configured to retain the sliding sleeve in a first configuration and to selectively permit the sliding sleeve to transition from the first configuration to a second configuration.

23 Claims, 8 Drawing Sheets

(51) Int. Cl.

| | |
|---|---|
| ***E21B 43/12*** | (2006.01) |
| *E21B 43/26* | (2006.01) |
| *E21B 34/00* | (2006.01) |

(56) References Cited

U.S. PATENT DOCUMENTS

| | | | | |
|---|---|---|---|---|
| 5,579,844 | A | 12/1996 | Rebardi et al. | |
| 5,704,426 | A | 1/1998 | Rytlewski et al. | |
| 5,829,520 | A | 11/1998 | Johnson | |
| 6,543,538 | B2 | 4/2003 | Tolman et al. | |
| 6,907,936 | B2 | 6/2005 | Fehr et al. | |
| 6,957,701 | B2 | 10/2005 | Tolman et al. | |
| 7,059,407 | B2 | 6/2006 | Tolman et al. | |
| 7,168,494 | B2 | 1/2007 | Starr et al. | |
| 7,353,879 | B2 | 4/2008 | Todd et al. | |
| 7,477,160 | B2 | 1/2009 | Lemenager et al. | |
| 7,516,792 | B2 | 4/2009 | Lonnes et al. | |
| 7,575,062 | B2 | 8/2009 | East, Jr. | |
| 7,735,559 | B2 | 6/2010 | Malone | |
| 7,798,236 | B2 | 9/2010 | McKeachnie et al. | |
| 8,167,047 | B2 | 5/2012 | Themig et al. | |
| 8,215,411 | B2 | 7/2012 | Flores et al. | |
| 8,220,542 | B2 | 7/2012 | Whitsitt et al. | |
| 8,237,585 | B2 | 8/2012 | Zimmerman | |
| 8,267,177 | B1 | 9/2012 | Vogel et al. | |
| 8,276,670 | B2 | 10/2012 | Patel | |
| 8,330,617 | B2 | 12/2012 | Chen et al. | |
| 8,347,982 | B2 | 1/2013 | Hannegan et al. | |
| 8,496,055 | B2 | 7/2013 | Mootoo et al. | |
| 9,366,109 | B2 * | 6/2016 | Themig | E21B 34/14 |
| 2002/0007949 | A1 | 1/2002 | Tolman et al. | |
| 2004/0084190 | A1 | 5/2004 | Hill et al. | |
| 2004/0099447 | A1 * | 5/2004 | Howlett | E21B 34/14 175/317 |
| 2004/0123984 | A1 * | 7/2004 | Vail, III | E21B 7/065 166/291 |
| 2006/0113115 | A1 * | 6/2006 | Lee | E21B 21/103 175/317 |
| 2006/0118301 | A1 | 6/2006 | East, Jr. et al. | |
| 2008/0093073 | A1 | 4/2008 | Bustos et al. | |
| 2008/0156498 | A1 * | 7/2008 | Phi | E21B 43/26 166/376 |
| 2009/0032255 | A1 | 2/2009 | Surjaatmadja et al. | |
| 2009/0084555 | A1 * | 4/2009 | Lee | E21B 10/322 166/319 |
| 2009/0101334 | A1 | 4/2009 | Baser et al. | |
| 2010/0084134 | A1 | 4/2010 | Tulissi et al. | |
| 2011/0048743 | A1 | 3/2011 | Stafford et al. | |
| 2011/0168403 | A1 | 7/2011 | Patel | |
| 2012/0043079 | A1 | 2/2012 | Wassouf et al. | |
| 2012/0085548 | A1 | 4/2012 | Fleckenstein et al. | |
| 2012/0090687 | A1 | 4/2012 | Grigsby et al. | |
| 2012/0111566 | A1 | 5/2012 | Sherman et al. | |
| 2012/0199349 | A1 | 8/2012 | Themig et al. | |
| 2012/0292053 | A1 | 11/2012 | Xu et al. | |
| 2013/0000926 | A1 * | 1/2013 | Parrott | E21B 43/26 166/386 |
| 2013/0008648 | A1 | 1/2013 | Lovorn et al. | |
| 2013/0105159 | A1 | 5/2013 | Alvarez et al. | |
| 2013/0199790 | A1 | 8/2013 | Themig et al. | |
| 2013/0206425 | A1 | 8/2013 | Mazyar et al. | |
| 2013/0248174 | A1 | 9/2013 | Dale et al. | |
| 2013/0319767 | A1 * | 12/2013 | Wilson | E21B 21/10 175/24 |

* cited by examiner

FLOW CONTROL ASSEMBLIES FOR DOWNHOLE OPERATIONS AND SYSTEMS AND METHODS INCLUDING THE SAME

CROSS-REFERENCE TO RELATED APPLICATIONS

This application is the National Stage of International Application No. PCT/US2013/070605, filed Nov. 18, 2013, which claims the benefit of U.S. Provisional Patent Application No. 61/745,136, filed Dec. 21, 2012, and U.S. Provisional Patent Application No. 61/834,296, filed Jun. 12, 2013, the disclosures of both are hereby incorporated by reference.

FIELD OF THE DISCLOSURE

The present disclosure is directed generally to flow control assemblies for downhole operations and more particularly to flow control assemblies that include a sliding sleeve that includes and/or defines an isolation ball seat and a housing that includes and/or defines an injection conduit and a ball sealer seat.

BACKGROUND OF THE DISCLOSURE

Wells, such as hydrocarbon wells and/or oil wells, may include a casing string that defines a casing conduit and extends between a surface region and a subterranean formation. During construction and/or operation of the well, it may be desirable to perform any one of a number of downhole operations. Illustrative, non-exclusive examples of these downhole operations include locating one or more downhole tools within the casing conduit, stimulating at least a portion of the subterranean formation, fluidly isolating an uphole portion of the casing conduit from a downhole portion of the casing conduit, and/or fluidly isolating the casing conduit from the subterranean formation.

These downhole operations may utilize one or more flow control assemblies to control fluid flows within the casing conduit and/or between the casing conduit and the subterranean formation. However, current flow control assemblies may not provide a desired level of operational flexibility and/or may be costly to install, utilize, and/or remove from the casing conduit. Thus, there exists a need for improved flow control assemblies for downhole operations.

SUMMARY OF THE DISCLOSURE

Flow control assemblies for downhole operations and systems and methods including the same are disclosed herein. The flow control assemblies include a housing that includes a housing body that defines a housing conduit, an injection conduit that extends through the housing body, and a ball sealer seat. The ball sealer seat defines a portion of the injection conduit, is defined on an inner surface of the housing, and is sized to receive a ball sealer to restrict fluid flow from the casing conduit through the injection conduit.

The flow control assemblies further include a sliding sleeve that is located within the housing conduit, defines an isolation ball seat, and is configured to selectively transition between a first configuration and a second configuration. In the first configuration, the sliding sleeve resists an injection conduit fluid flow through the injection conduit, while, in the second configuration, the sliding sleeve permits the injection conduit fluid flow. The isolation ball seat is configured to receive an isolation ball to selectively restrict fluid flow from a portion of the casing conduit that is uphole from the flow control assembly to a portion of the casing conduit that is downhole from the flow control assembly.

The flow control assemblies also include a retention structure. The retention structure is configured to retain the sliding sleeve in a first configuration and to selectively permit the sliding sleeve to transition from the first configuration to a second configuration responsive to receipt of the isolation ball by the sliding sleeve and/or when the isolation ball is located on the isolation ball seat and a pressure differential across the isolation ball is greater than a threshold pressure differential.

DETAILED DESCRIPTION AND BEST MODE OF THE DISCLOSURE

Figure 1:
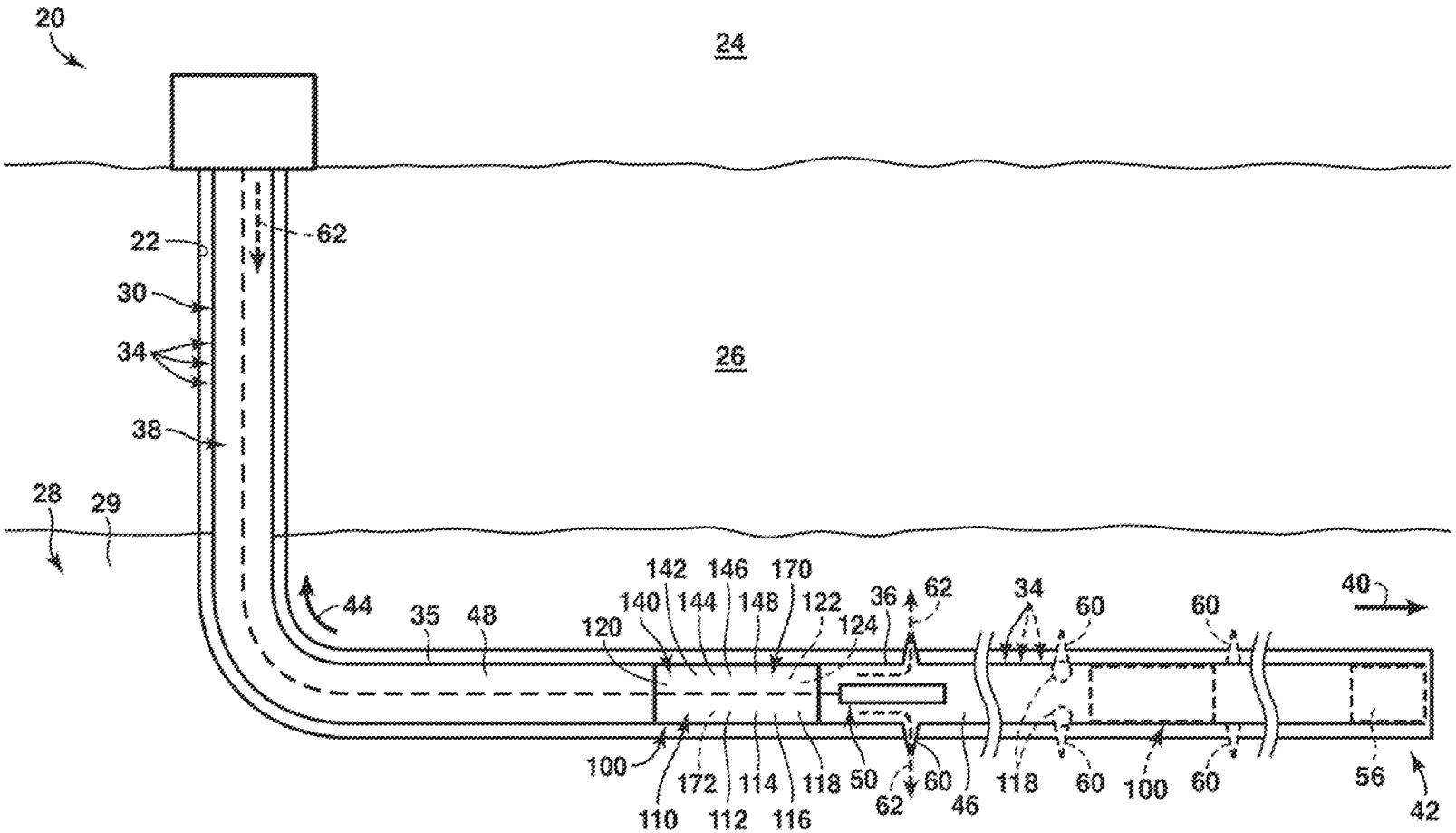
FIG. 1 is a schematic representation of illustrative, non-exclusive examples of a hydrocarbon well that may be utilized with and/or include the systems and methods according to the present disclosure.

FIGS. 1-12 provide illustrative, non-exclusive examples of flow control assemblies 100 according to the present disclosure, of components of flow control assemblies 100, and/or of casing strings 30 and/or hydrocarbon wells 20 that may include and/or utilize flow control assemblies 100. Elements that serve a similar, or at least substantially similar, purpose are labeled with like numbers in each of FIGS. 1-12, and these elements may not be discussed in detail herein with reference to each of FIGS. 1-12. Similarly, all elements may not be labeled in each of FIGS. 1-12, but reference numerals associated therewith may be utilized herein for consistency. Elements, components, and/or features that are discussed herein with reference to one or more of FIGS. 1-12 may be included in and/or utilized with any of FIGS. 1-12 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic representation of illustrative, non-exclusive examples of a hydrocarbon well 20 that may be utilized with and/or include the systems and methods according to the present disclosure. Hydrocarbon well 20 includes, defines, and/or is associated with a wellbore 22 that extends between a surface region 24 and a subterranean formation 28 that is present within a subsurface region 26. Hydrocarbon well 20 also includes a casing string 30 that extends within wellbore 22 and defines a casing conduit 38 therein.

As illustrated in FIG. 1 and discussed in more detail herein, hydrocarbon well 20 may include (and/or casing conduit 38 may contain) a perforation device 50 that is configured to create one or more perforations 60 within casing string 30. Perforations 60 may permit stimulation of subterranean formation 28, such as by permitting flow of a stimulant fluid 62 from casing conduit 38 into subterranean formation 28. Additionally or alternatively, perforations 60 also may permit production of a reservoir fluid 29, from subterranean formation 28 to surface region 24 via casing conduit 38. Reservoir fluid 29 additionally or alternatively may be referred to herein as and/or may be a hydrocarbon 29 and/or a hydrocarbon fluid 29. Perforation device 50 may include and/or define any suitable structure that is configured to create perforations 60. As an illustrative, non-exclusive example, perforation device 50 may include and/or be a perforation gun that includes a plurality of perforation charges.

As illustrated in dashed lines in FIG. 1 and also discussed in more detail herein, one or more ball sealers 118 may be selectively located within casing conduit 38 and, when present, may prevent a fluid flow from the casing conduit into the subterranean formation. In addition, and as also illustrated in dashed lines in FIG. 1, casing conduit 38 further may include an isolation plug 56, which may be configured to fluidly isolate at least a portion of casing conduit 38 from subterranean formation 28.

Hydrocarbon well 20 and/or wellbore 22, casing string 30, and/or casing conduit 38 thereof may define an uphole direction 44 and a downhole direction 40. Uphole direction 44 may define a direction within and/or along a length of wellbore 22, casing string 30, and/or casing conduit 38 that is directed toward surface region 24. Conversely, downhole direction 40 may define a direction within and/or along a length of wellbore 22, casing string 30, and/or casing conduit 38 that is directed away from surface region 24 and/or toward a terminal end 42 of wellbore 22.

Additionally or alternatively, uphole direction 44 and downhole direction 40 may be relative terms that may be utilized herein to describe a relative location of one portion of hydrocarbon well 20 with respect to another portion of hydrocarbon well 20. As an illustrative, non-exclusive example, and in the illustrative, non-exclusive example of FIG. 1, terminal end 42 may be downhole, or located downhole, from ball sealers 118 and/or from perforation device 50. Similarly, ball sealers 118 and/or perforation device 50 may be uphole, or located uphole, from terminal end 42.

Casing string 30 includes a plurality of lengths of casing 34 and at least one flow control assembly 100. As an illustrative, non-exclusive example, casing string 30 may include at least a first length (or portion) 35 of casing 34 that defines a first, or uphole, portion 48 of casing conduit 38 and a second length (or portion) 36 of casing 34 that defines a second, or downhole, portion 46 of casing conduit 38. Flow control assembly 100 may be located between and/or may be operatively attached to first length 35 and second length 36. As discussed in more detail herein, flow control assembly 100 may be configured to selectively and fluidly isolate uphole portion 48 from downhole portion 46.

It is within the scope of the present disclosure that casing string 30 may include any suitable number of lengths of casing 34 and/or any suitable number of flow control assemblies 100. As illustrative, non-exclusive examples, casing string 30 may include a plurality of lengths of casing 34 and a plurality of flow control assemblies 100, with each flow control assembly 100 being located between a respective pair of lengths of casing 34 and being configured to fluidly isolate a portion of casing conduit 38 that is uphole from the flow control assembly from a portion of the casing conduit that is downhole from the flow control assembly. As additional illustrative, non-exclusive examples, casing string 30 may include at least 2, at least 3, at least 4, at least 5, at least 6, at least 7, at least 8, at least 9, at least 10, at least 12, at least 14, at least 16, at least 18, at least 20, at least 22, at least 24, at least 26, at least 28, or at least 30 flow control assemblies and/or a corresponding number of respective pairs of lengths of casing 34.

Flow control assembly 100 may include any suitable structure that may form a portion of casing sting 30, that may be configured to selectively control a fluid flow (such as in uphole direction 44 and/or downhole direction 40) within casing conduit 38, and/or that may be configured to selectively control a fluid flow between casing conduit 38 and subterranean formation 28. More specific but still illustrative, non-exclusive examples of flow control assemblies 100 according to the present disclosure are illustrated in FIGS. 2-12 and discussed in more detail herein with reference thereto.

The flow control assemblies 100 of FIGS. 1-12 may include a housing 110 that includes a housing body 112. As illustrated in FIGS. 2-12, housing body 112 defines an inner surface 126 of housing 110, which defines a housing conduit 120 that forms a portion of casing conduit 38. The housing body also defines an outer surface 128 of housing 110, which may be opposed to inner surface 126 and/or may be proximal to and/or in direct fluid communication with subterranean formation 28 (when the flow control assembly is present within the subterranean formation). When flow control assembly 100 is located within casing string 30, housing body 112 may be referred to herein as defining a portion of the casing string and/or as being located within the casing string.

Housing body 112 also defines an injection conduit 114 that extends through the housing body between inner surface 126 and outer surface 128. Thus, when flow control assembly 100 is present within subterranean formation 28, injection conduit 114 extends and/or provides fluid communication between housing conduit 120 and/or casing conduit 38 and subterranean formation 28. Illustrative, non-exclusive examples of injection conduit 114 are discussed in more detail herein.

Figure 7:
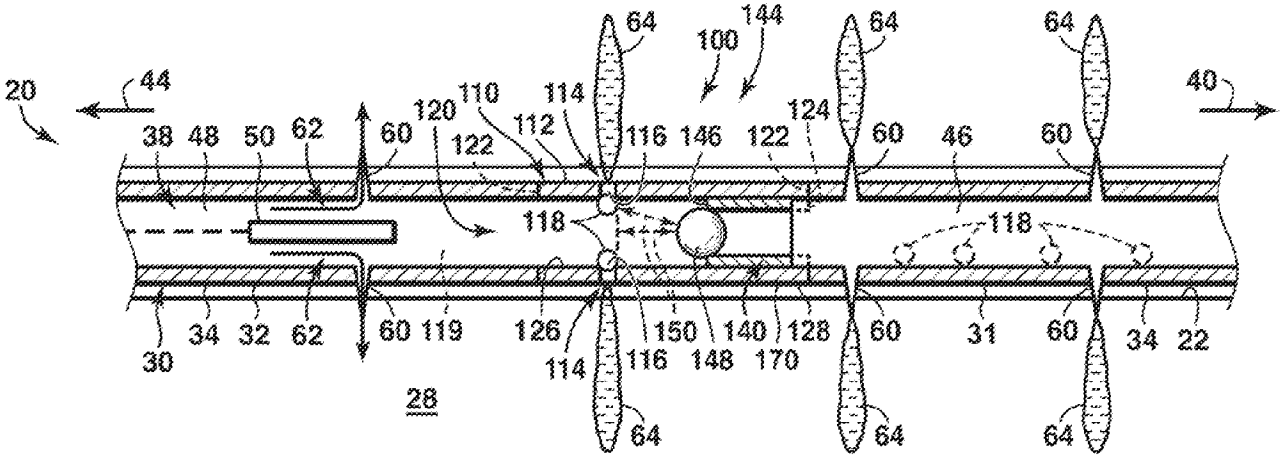
FIG. 7 is another schematic representation of illustrative, non-exclusive examples of a stimulation process that may be performed in a hydrocarbon well and that may include and/or utilize the systems and methods according to the present disclosure.
Figure 11:
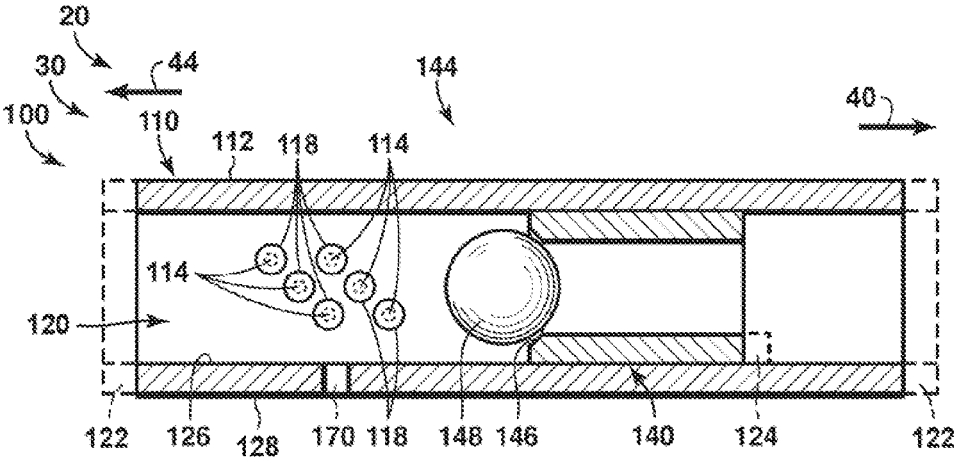
FIG. 11 is another less schematic representation of illustrative, non-exclusive examples of a flow control assembly according to the present disclosure in the second configuration.

Housing 110 and/or housing body 112 thereof further includes and/or defines a ball sealer seat 116. Ball sealer seat 116 defines a portion of injection conduit 114 and may be defined on, near, and/or by inner surface 126 of housing 110. Ball sealer seat 116 may be formed with the housing body or separately formed and then secured to the housing body. Ball sealer seat 116 is sized to receive a ball sealer 118 (as illustrated in FIGS. 7 and 11). When present on ball sealer seat 116, ball sealer 118 restricts fluid flow from casing conduit 38 through injection conduit 114. Illustrative, non-exclusive examples of ball sealer seats 116 are discussed in more detail herein with reference to FIG. 12.

Flow control assembly 100 further includes a sliding sleeve 140 that is located within housing conduit 120. Sliding sleeve 140 is configured to selectively transition between a first configuration 142, as illustrated in FIGS. 2-5 and 9, and a second configuration 144, as illustrated in FIGS. 6-8 and 10-11. When sliding sleeve 140 is in first configuration 142, the sliding sleeve resists, blocks, occludes, and/or stops a fluid flow through the injection conduit. Although not required, this fluid flow may be referred to herein as an injection conduit fluid flow. Conversely, when sliding sleeve 140 is in second configuration 144, the sliding sleeve permits, facilitates, allows, and/or provides for the fluid flow through the injection conduit.

Sliding sleeve 140 further includes an isolation ball seat 146 that is sized and/or configured to receive an isolation ball 148. When isolation ball 148 is not present on isolation ball seat 146, flow control assembly 100 permits a fluid flow therethrough within casing conduit 38, such as from uphole portion 48 of the casing conduit to downhole portion 46 of the casing conduit, or vice versa. Conversely, and when isolation ball 148 is present on isolation ball seat 146, flow control assembly 100 restricts, blocks, occludes, and/or stops a fluid flow from uphole portion 48 of casing conduit 38 to downhole portion 46 of the casing conduit.

Flow control assembly 100 also includes a retention structure 170. Retention structure 170 is configured to retain sliding sleeve 140 in the first configuration and to selectively permit the sliding sleeve to transition to the second configuration responsive to receipt of isolation ball 148 by sliding sleeve 140 (or isolation ball seat 146 thereof) and/or when isolation ball 148 contacts and/or otherwise is located on isolation ball seat 146 and a pressure differential across the isolation ball is greater than a threshold pressure differential. As an illustrative, non-exclusive example, retention structure 170 may include and/or be at least one shear pin that is configured to retain the sliding sleeve in the first configuration and to permit the sliding sleeve to transition from the first configuration to the second configuration upon, responsive to, or as a result of, shearing of the shear pins.

It is within the scope of the present disclosure that retention structure 170 (optionally) also may be configured to retain sliding sleeve 140 in the second configuration. As such, the sliding sleeve may be configured to be retained in the second configuration subsequent to transitioning thereto.

Alternatively, it is also within the scope of the present disclosure that the retention structure may include an optional biasing mechanism 172 (as illustrated in FIG. 1) that is configured to bias the sliding sleeve to the first configuration. As such, the sliding sleeve may be configured to return to the first configuration (via a motive force that may be applied by the biasing mechanism) responsive to the pressure differential across the isolation ball being less than the threshold pressure differential.

In addition, flow control assembly 100 also may include and/or be associated with one or more attachment structures 122 (as illustrated in dashed lines in FIGS. 1-11) and/or a sleeve stop 124 (as illustrated in dashed lines in FIGS. 1-8). Attachment structures 122 may include any suitable structure that may be configured and/or designed to operatively attach flow control assembly 100 to respective lengths of casing 34. Sleeve stop 124 may include any suitable structure that is configured to limit a motion of sliding sleeve 140 when the sliding sleeve transitions between the first configuration and the second configured, from the first configuration to the second configuration, and/or from the second configuration to the first configuration.

FIGS. 2-8 are schematic representations of illustrative, non-exclusive examples of a stimulation process that may be performed in a portion of hydrocarbon well 20 and that may include and/or utilize the systems and methods according to the present disclosure. In addition, FIGS. 2-8 illustrate various configurations for hydrocarbon well 20 and/or components thereof, such as perforation device 50, flow control assembly 100, ball sealers 118, and/or isolation ball 148 that are within the scope of the present disclosure.

Figure 2:
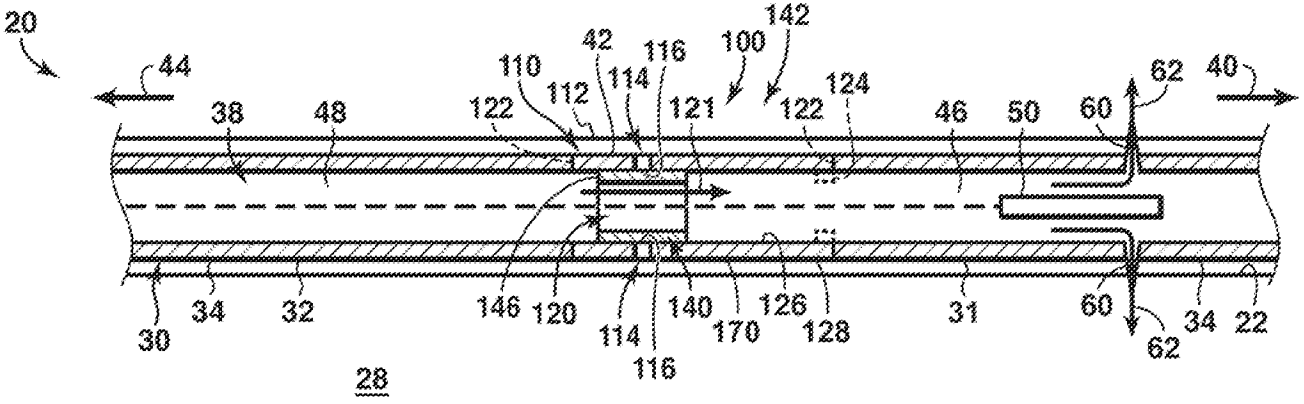
FIG. 2 is a schematic representation of illustrative, non-exclusive examples of a stimulation process that may be performed in a hydrocarbon well and that may include and/or utilize the systems and methods according to the present disclosure.

As illustrated in FIG. 2, stimulation of subterranean formation 28 may include locating perforation device 50 downhole from flow control assembly 100 (or in downhole portion 46 of casing conduit 38 that is defined by a downhole portion 31 of casing string 30) and creating one or more perforations 60 within casing string 30 with the perforation device. Flow control assembly 100 (or sliding sleeve 140 thereof) may be in first configuration 142, and the isolation ball may not be located on isolation ball seat 146. As such, the flow control assembly restricts an injection conduit fluid flow through injection conduits 114 but permits a housing conduit fluid flow 121 through housing conduit 120. Thus, and subsequent to formation of perforations 60, a stimulant fluid 62 may be provided from casing conduit 38 to subterranean formation 28 via perforations 60 to stimulate the subterranean formation. This stimulant fluid may create, or generate, one or more stimulated regions 64 within the subterranean formation, as illustrated in FIG. 3.

Figure 3:
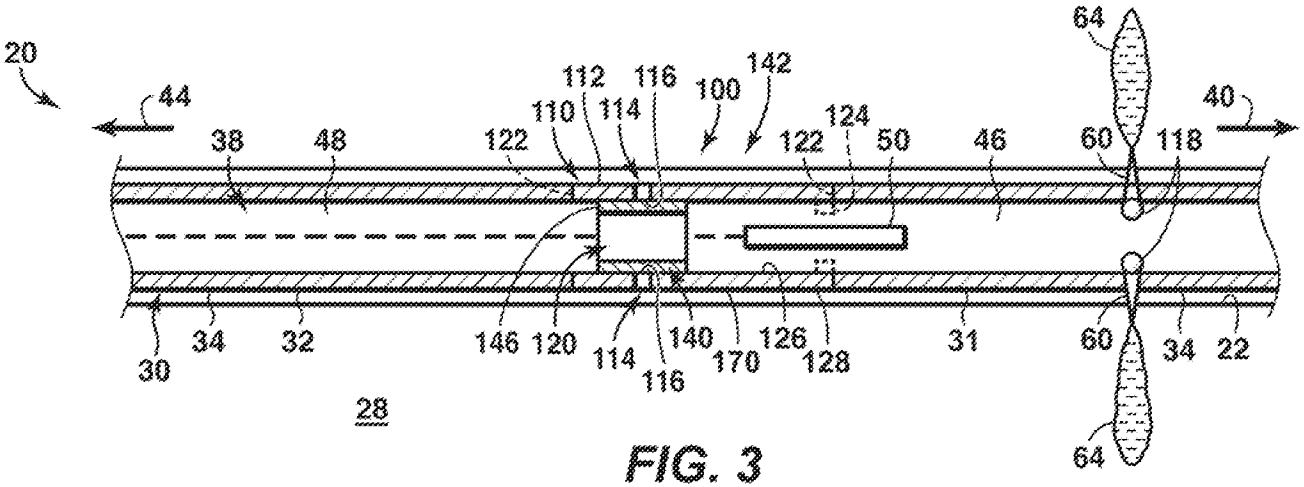
FIG. 3 is another schematic representation of illustrative, non-exclusive examples of a stimulation process that may be performed in a hydrocarbon well and that may include and/or utilize the systems and methods according to the present disclosure.
Figure 4:
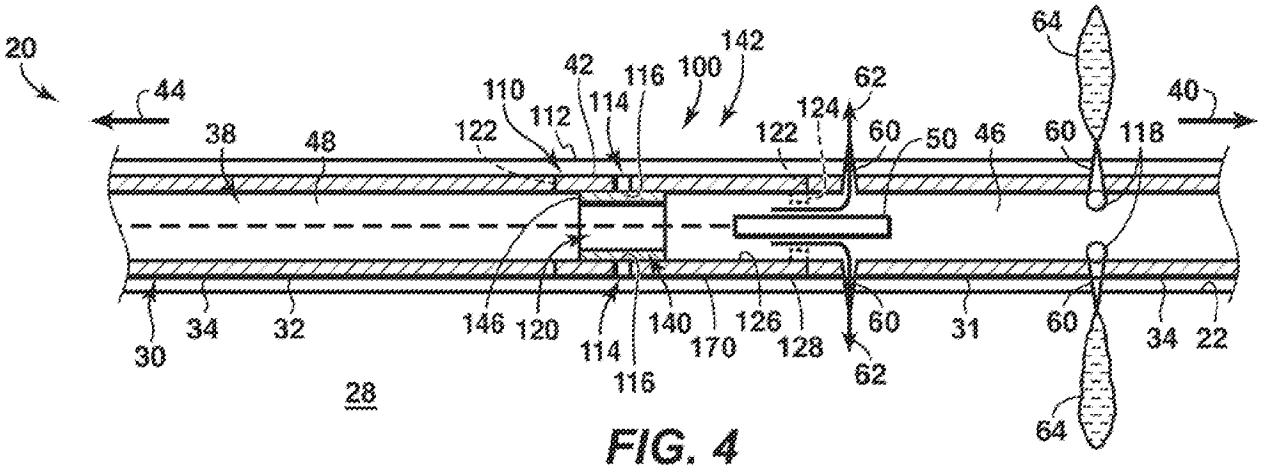
FIG. 4 is another schematic representation of illustrative, non-exclusive examples of a stimulation process that may be performed in a hydrocarbon well and that may include and/or utilize the systems and methods according to the present disclosure.

As also illustrated in FIG. 3, the stimulation process further may include moving perforation device 50 uphole from perforations 60 and locating ball sealers 118 on perforations 60 to fluidly isolate casing conduit 38 from subterranean formation 28 and to permit pressurization of the casing conduit, with this pressurization retaining ball sealers 118 on perforations 60. Subsequently, and as illustrated in FIG. 4, one or more additional perforations 60 may be created by perforation device 50 within downhole portion 46, and stimulant fluid 62 may flow from casing conduit 38 to subterranean formation 28 via the additional perforations. This process may be repeated any suitable number of times to create any suitable number of perforations within downhole portion 46 and/or to create, or generate, any suitable number of stimulated regions 64 within the subterranean formation.

Figure 5:
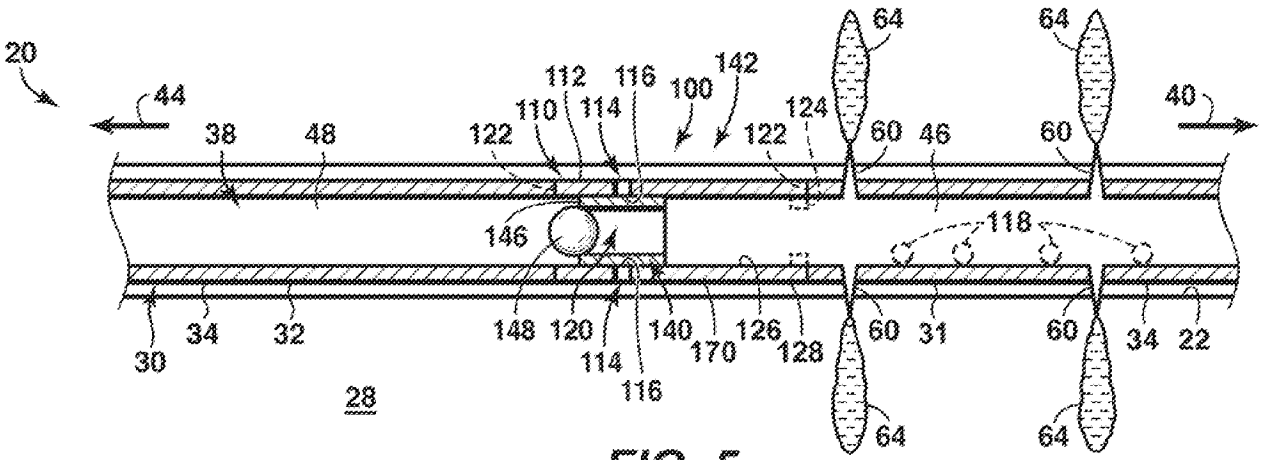
FIG. 5 is another schematic representation of illustrative, non-exclusive examples of a stimulation process that may be performed in a hydrocarbon well and that may include and/or utilize the systems and methods according to the present disclosure.

Subsequently, perforation device 50 may be moved uphole from flow control assembly 100 (or into an uphole portion 48 of casing conduit 38 that is defined by an uphole portion 32 of casing string 30) and/or the perforation device may be removed from casing conduit 38. Then, and as illustrated in FIG. 5, an isolation ball 148 may be located and/or received on isolation ball seat 146. As discussed in more detail herein, this may include flowing the isolation ball from the surface region, through uphole portion 48, optionally past perforation device 50, and into sealing contact with the isolation ball seat.

In FIG. 5, flow control assembly 100 remains in first configuration 142. As such, isolation ball 148 fluidly isolates uphole portion 48 from downhole portion 46 and/or the flow control assembly resists the housing conduit fluid flow through flow control assembly 100 in downhole direction 40. In addition, flow control assembly 100 resists the injection conduit fluid flow through injection conduits 114.

Figure 6:
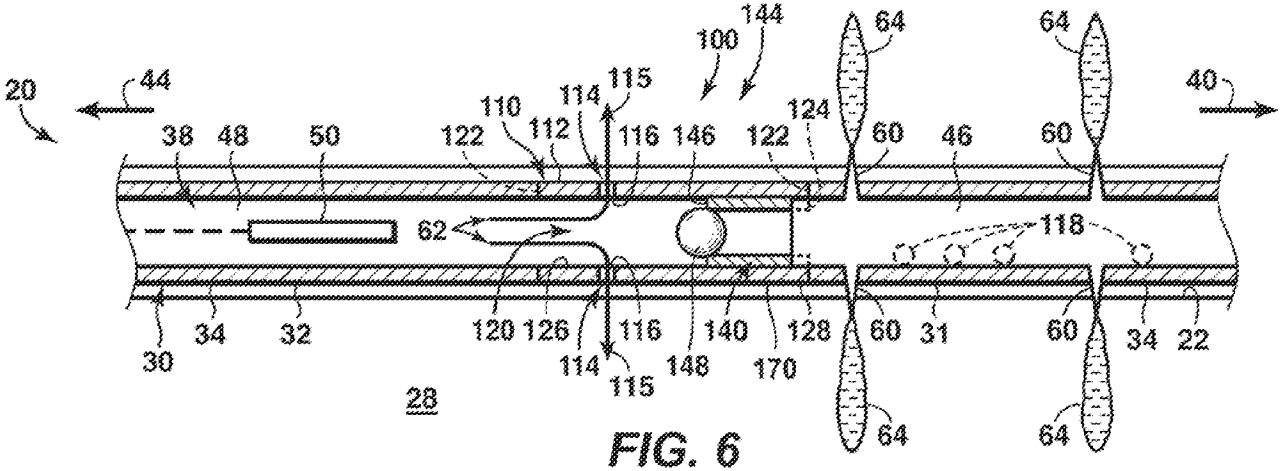
FIG. 6 is another schematic representation of illustrative, non-exclusive examples of a stimulation process that may be performed in a hydrocarbon well and that may include and/or utilize the systems and methods according to the present disclosure.

Thus, supply of fluid to uphole portion 48 will increase the pressure therein. Additionally or alternatively, ball sealers 118 may not be retained on perforations within downhole portion 46 and/or the pressure within downhole portion 46 may decrease. When sliding sleeve 140 (or isolation ball seat 146 thereof) receives, and/or is contacted or otherwise engaged by, isolation ball 148 and/or when a pressure differential across isolation ball 148 (i.e., a difference between the pressure within uphole portion 48 and the pressure within downhole portion 46) exceeds a threshold pressure differential, flow control assembly 100 (or sliding sleeve 140 thereof) may transition to second configuration 144, as illustrated in FIG. 6. As discussed, this transitioning may be responsive to the pressure differential causing the shearing of one or more shear pins or otherwise causing retention structure to release the sliding sleeve to move to the second configuration. This may include translating sliding sleeve 140 in downhole direction 40 and/or translating the sliding sleeve along a longitudinal axis of casing conduit 38. Thus, and as illustrated in FIG. 6, sliding sleeve 140 may be located downhole from injection conduits 114 and/or ball sealer seats 116 when flow control assembly 100 is in the second configuration.

As also illustrated in FIG. 6, isolation ball 148 is located on isolation ball seat 146. Thus, flow control assembly 100 resists the housing conduit fluid flow through housing conduit 120 in downhole direction 40. However, the flow control assembly permits injection conduit fluid flow 115, which may include and/or be a flow of stimulant fluid 62, from casing conduit 38 to subterranean formation 28 through injection conduits 114. Thus, the injection conduit fluid flow may stimulate subterranean formation 28 and/or may create one or more stimulated regions 64 within the subterranean formation (as illustrated in FIG. 7).

With continued reference to FIG. 6, and during stimulation of subterranean formation 28 via injection conduit fluid flow 115, perforation device 50 may be located within uphole portion 48 of casing conduit 38. As discussed in more detail herein, this may include flowing the perforation device within casing conduit 38 and in downhole direction 40 with stimulant fluid 62 that forms injection conduit fluid flow 115.

Subsequently, and as illustrated in FIG. 7, one or more ball sealers 118 may be received, or located, on ball sealer seats 116 of injection conduit 114. Thus, ball sealers 118 may restrict, occlude, prevent, or otherwise limit the injection conduit fluid flow into the subterranean formation. In addition, and as also illustrated in FIG. 7, isolation ball 148 may remain on isolation ball seat 146, and flow control assembly 100 (or sliding sleeve 140 thereof) may remain in second configuration 144. Thus, the flow control assembly may resist the housing conduit fluid flow therethrough in downhole direction 40. Therefore, uphole portion 48 of casing conduit 38 may be fluidly isolated from subterranean formation 28. This may permit fluid that may be supplied to uphole portion 48 to pressurize the uphole portion of the casing conduit. Additionally or alternatively, this also may permit stimulant fluid 62 that may be supplied to uphole portion 48 to be focused and/or directed through perforations 60 that may be created in uphole portion 32 of casing string 30, thereby permitting additional stimulation of subterranean formation 28.

Similar to downhole portion 31, it is within the scope of the present disclosure that perforation device 50 may be utilized to create any suitable number of perforations within uphole portion 32. As discussed, this may include locating one or more ball sealers on a first set of perforations that are defined within uphole portion 32 and subsequently creating a second, or subsequent, set of perforations within uphole portion 32.

As illustrated in FIG. 7, flow control assembly 100 may be designed and/or configured to provide a clearance 150, which also may be referred to herein as a minimum clearance 150, between ball sealers 118 and sliding sleeve 140 and/or between the ball sealers and isolation ball 148 when flow control assembly 100 is in the second configuration and/or when isolation ball 148 is located on isolation ball seat 146. Minimum clearance 150 may be sized, or selected, to permit sealing of injection conduit 114 (or ball sealer seat 116) by ball sealer 118 without contact, or physical contact, between the ball sealer and isolation ball 148 and/or without contact between the ball sealer and sliding sleeve 140.

It is within the scope of the present disclosure that minimum clearance 150 may include and/or be any suitable value. As an illustrative, non-exclusive example, minimum clearance 150 may be greater than an outer radius (or greater than half an outer diameter) of ball sealer 118. As additional illustrative, non-exclusive examples, minimum clearance 150 may be at least 0.6 times, at least 0.7 times, at least 0.8 times, at least 0.9 times, at least 1 time, at least 1.1 times, at least 1.2 times, at least 1.3 times, at least 1.4 times, at least 1.5 times, at least 1.6 times, at least 1.7 times, at least 1.8 times, at least 1.9 times, or at least 2 times greater than the outer diameter (or other characteristic dimension) of the ball sealer. Additionally or alternatively, minimum clearance 150 also may be less than 5 times, less than 4.75 times, less than 4.5 times, less than 4 times, less than 3.75 times, less than 3.5 times, less than 3.25 times, less than 3 times, less than 2.75 times, less than 2.5 times, less than 2.25 times, less than 2 times, less than 1.75 times, or less than 1.5 times greater than the outer diameter (or other characteristic dimension) of the ball sealer.

It is also within the scope of the present disclosure that casing conduit 38 further may include one or more supplemental sealing materials 119 that may be selected and/or configured to supplement, improve, and/or increase sealing of injection conduits 114 by ball sealers 118 and/or the sealing of housing conduit 120 by isolation ball 148. As illustrative, non-exclusive examples, supplemental sealing materials 119 may be proximal to, in mechanical contact with, and/or in physical contact with ball sealers 118, injection conduits 114, ball sealer seats 116, isolation ball seats 146, and/or isolation balls 148. Illustrative, non-exclusive examples of supplemental sealing materials 119 include a supplemental ball sealer, a supplemental isolation ball, a natural or synthetic fibrous material, a particulate material, a granular material, cellophane flakes, organic media (such as plant hulls or shells, non-exclusive examples of which include cotton seed hulls and/or walnut shells), sawdust, benzoic acid flakes, shaved rock salt, and/or sieve-sided sand.

Figure 8:
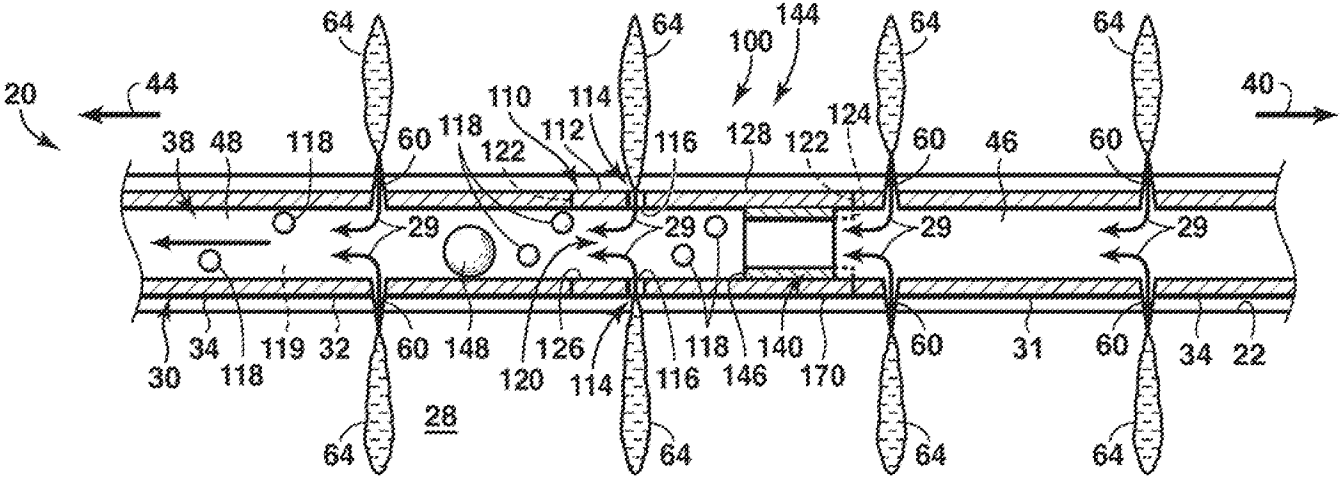
FIG. 8 is another schematic representation of illustrative, non-exclusive examples of a stimulation process that may be performed in a hydrocarbon well and that may include and/or utilize the systems and methods according to the present disclosure.

Subsequent to creation of perforations 60, subsequent to creation of a desired number of stimulated regions 64, and/or subsequent to stimulation of subterranean formation 28, and as illustrated in FIG. 8, reservoir fluid 29 may be produced from the subterranean formation. This may include flowing reservoir fluid 29 from subterranean formation 28 into casing conduit 38 through perforations 60. Additionally or alternatively, this also may include flowing reservoir fluid 29 from subterranean formation 28 into casing conduit 38 through injection conduits 114. As illustrated in FIG. 8, the flow of reservoir fluid 29 into casing conduit 38 may remove and/or displace ball sealers 118 from perforations 60, thereby permitting the reservoir fluid 29 to flow from the subterranean formation and into the casing conduit via the perforations. The flow of reservoir fluid 29 into casing conduit 38 also may remove and/or displace ball sealers 118 from ball sealer seats 116, permitting flow of reservoir fluid 29 from the subterranean formation and into the casing conduit via injection conduits 114. The flow of reservoir fluid 29 into casing conduit 38 further may remove and/or displace isolation ball 148 from isolation ball seat 146, thereby permitting flow of reservoir fluid 29 through housing conduit 120. Ball sealers 118 and/or isolation ball 148 may flow in uphole direction 44 with reservoir fluid 29, thereby permitting removal of the ball sealers and the isolation ball from casing conduit 38.

Figure 9:
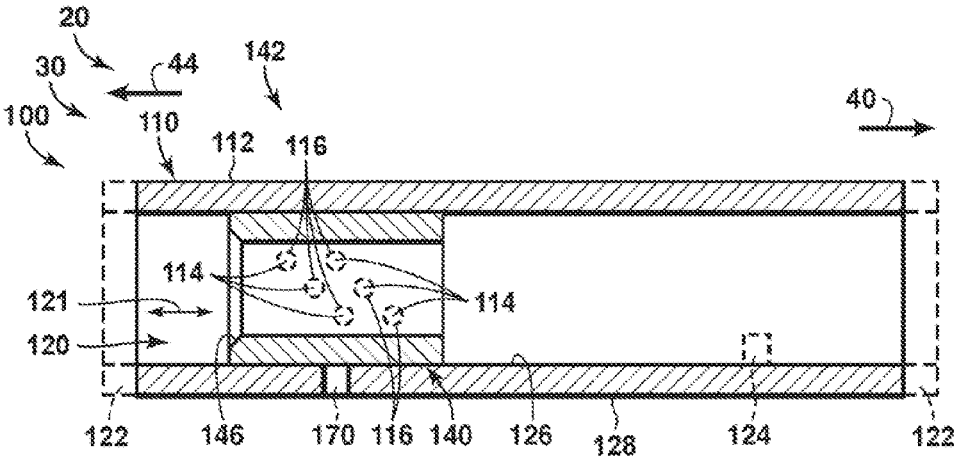
FIG. 9 is a less schematic representation of illustrative, non-exclusive examples of a flow control assembly according to the present disclosure in a first configuration.
Figure 10:
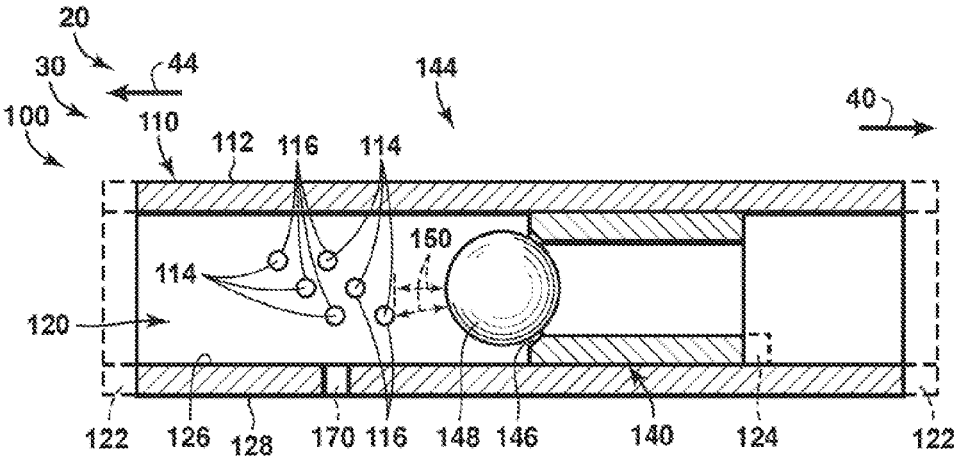
FIG. 10 is a less schematic representation of illustrative, non-exclusive examples of a flow control assembly according to the present disclosure in a second configuration.

FIGS. 9-11 provide less schematic but still illustrative, non-exclusive examples of a flow control assembly 100 according to the present disclosure that may form a portion of a casing string 30 and/or of a hydrocarbon well 20. In FIG. 9, the flow control assembly is in a first configuration 142, in which the flow control assembly resists a fluid flow (or an injection conduit fluid flow) through injection conduits 114. However, the flow control assembly permits a housing conduit fluid flow 121 through housing conduit 120.

In FIG. 10, an isolation ball 148 is located on isolation ball seat 146 of sliding sleeve 140 and flow control assembly 100 (or sliding sleeve 140 thereof) has transitioned to a second configuration 144, wherein the flow control assembly permits the fluid flow (or the injection conduit fluid flow) through injection conduits 114. However, the isolation ball resists, or prevents, the housing conduit fluid flow in downhole direction 40 through housing conduit 120.

FIG. 10 also illustrates minimum clearance 150, which was discussed in more detail herein. As illustrated in FIG. 10, minimum clearance 150 may be defined as a minimum distance between ball sealer seats 116 (or ball sealers 118, when present thereon) and isolation ball 148 and/or as a distance between ball sealer seats 116 (or ball sealers 118, when present thereon) and isolation ball 148 as measured along a longitudinal axis of flow control assembly 100.

In FIG. 11, the flow control assembly is in second configuration 144, and isolation ball 148 is located on isolation ball seat 146 and resists the housing conduit fluid flow in downhole direction 40 through housing conduit 120. In addition, ball sealers 118 are located on ball sealer seats 116 and resist the fluid flow (or the injection conduit fluid flow) through injection conduits 114.

Figure 12:
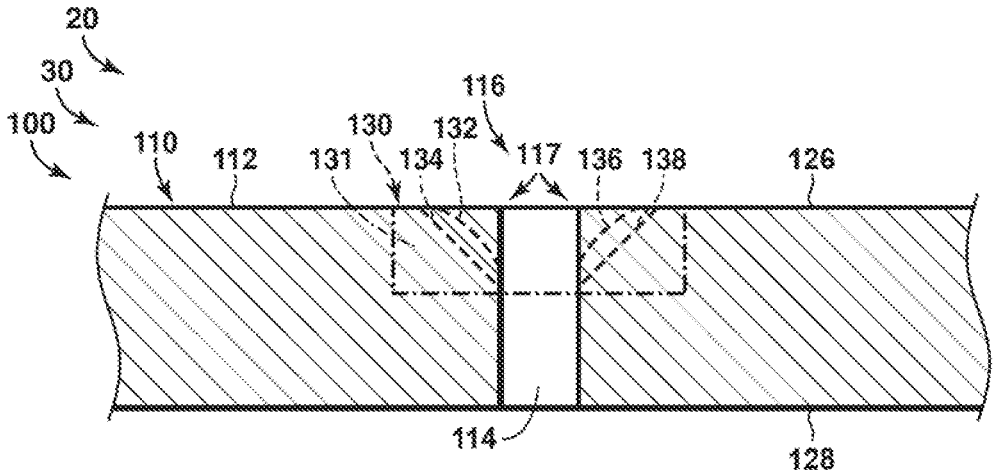
FIG. 12 is a schematic representation of illustrative, non-exclusive examples of a portion of a housing body that includes and/or defines a ball sealer seat and may form a portion of a flow control assembly according to the present disclosure.

FIG. 12 is a schematic representation of illustrative, non-exclusive examples of a portion of a housing 110 that includes and/or defines a ball sealer seat 116 and may form a portion of a flow control assembly 100 according to the present disclosure. Ball sealer seats 116 according to the present disclosure may be specifically configured, designed, machined, sized, and/or selected to form a fluid seal with a ball sealer, when present thereon. As such, a size, shape, and/or material of construction of the ball sealer seat may be selected to permit, encourage, and/or facilitate effective sealing by the ball sealer.

As an illustrative, non-exclusive example, ball sealer seats 116 may include and/or define a ball sealer sealing surface 117 that is specifically configured to form the fluid seal. In contrast to a portion of casing string 30 that may define perforations 60 (as illustrated in FIGS. 1-8), ball sealer sealing surface 117 may include and/or be a smooth surface and/or a regular surface. As an illustrative, non-exclusive example, the ball sealer sealing surface may include and/or be a circular, or at least substantially circular, ball sealer sealing perimeter, edge, surface, or surface region. As additional illustrative, non-exclusive examples, ball sealer sealing surface 117 may include a rounded edge (or edge region) 132, a chamfered, or tapered, edge 134 (or edge region), and/or an edge (or edge region) 133 that is shaped to conform to the shape of the portion of a ball sealer that engages the edge.

It is within the scope of the present disclosure that ball sealer seat 116 may be defined by and/or formed from the same material as housing body 112. Alternatively, it is also within the scope of the present disclosure that ball sealer seat 116 may be defined by and/or formed from a material that is different from, or has a different material composition than, that of housing body 112. As illustrative, non-exclusive examples, ball sealer seat 116 may include and/or be defined by a coating 136 that is operative attached to housing body 112, a surface treatment 138 of housing body 112, and/or an insert 130 that is operatively attached to housing body 112 and is defined by an insert material 131 that may be different from a material that defines housing body 112.

Additionally or alternatively, it is also within the scope of the present disclosure that ball sealer seat 116 (and/or a material of construction thereof) may be selected to improve formation of the fluid seal with the ball sealer and/or to resist damage during flow of fluid, granular materials, and/or proppant therethrough. As illustrative, non-exclusive examples, the ball sealer seat may include and/or be an erosion-resistant ball sealer seat, a corrosion-resistant ball sealer seat, a hardened ball sealer seat, a resilient ball sealer seat, an elastomeric ball sealer seat, and/or a compliant ball sealer seat. Accordingly, the ball sealer seat may be constructed of, be coated with, be lined with, and/or include (i) a material and/or composition (including, but not limited to, a carbide seat or a carbide insert or engagement surface for a seat that is formed from a different composition, such as the same composition as the housing body) that is harder and/or more resistant to abrasion than the material from which housing body 112 is formed, (ii) a material that is less reactive and/or more resistant to corrosion (in wellbore environments) than the material from which housing body 112 is formed, and/or (iii) a material that is softer and/or more resilient, and/or compressible, and/or compliant than the material from which housing body 112 is formed.

It is within the scope of the present disclosure that ball sealer sealing surface 117 may define any suitable diameter, or inner diameter. As illustrative, non-exclusive examples, the inner diameter of the ball sealer sealing surface may be at least 0.5 centimeters (cm), at least 0.6 cm, at least 0.7 cm, at least 0.8 cm, at least 0.9 cm, at least 1 cm, or at least 1.1 cm. Additionally or alternatively, the inner diameter of the ball sealer sealing surface also may be less than 1.5 cm, less than 1.4 cm, less than 1.3 cm, less than 1.2 cm, less than 1.1 cm, or less than 1 cm.

It is also within the scope of the present disclosure that the inner diameter of the ball sealer sealing surface may be selected relative to an outer diameter of a ball sealer that is configured to form the fluid seal therewith. As illustrative, non-exclusive examples, the inner diameter of the ball sealer sealing surface may be at least 25%, at least 30%, at least 35%, at least 40%, at least 45%, at least 50%, at least 55%, at least 60%, at least 65%, at least 70%, or at least 75% of an outer diameter of the ball sealer. Additionally or alternatively, the inner diameter of the ball sealer sealing surface also may be less than 95%, less than 90%, less than 85%, less than 80%, less than 75%, less than 70%, less than 65%, less than 60%, less than 55%, less than 50%, less than 45%, or less than 40% of the outer diameter of the ball sealer.

Illustrative, non-exclusive examples of outer diameters of ball sealers that may be utilized with the systems and methods according to the present disclosure include outer diameters of at least 1 cm, at least 1.1 cm, at least 1.2 cm, at least 1.3 cm, at least 1.4 cm, at least 1.5 cm, at least 1.6 cm, at least 1.7 cm, at least 1.8 cm, at least 1.9 cm, or at least 2 cm. Additionally or alternatively, the outer diameter of the ball sealers also may be less than 3 cm, less than 2.9 cm, less than 2.8 cm, less than 2.7 cm, less than 2.6 cm, less than 2.5 cm, less than 2.4 cm, less than 2.3 cm, less than 2.2 cm, less than 2.1 cm, or less than 2 cm.

It is further within the scope of the present disclosure that the inner diameter of the ball sealer sealing surface may be selected relative to an inner diameter of the casing conduit that is defined by the casing string and/or by the inner diameter of the housing conduit that is defined by housing body 112. As illustrative, non-exclusive examples, the inner diameter of the ball sealer sealing surface may be at least 1%, at least 2%, at least 3%, at least 4%, at least 5%, at least 6%, at least 7%, or at least 8% of the inner diameter of the casing conduit. Additionally or alternatively, the inner diameter of the ball sealer sealing surface also may be less than 15%, less than 14%, less than 13%, less than 12%, less than 11%, less than 10%, less than 9%, less than 8%, less than 7%, less than 6%, less than 5%, or less than 4% of the inner diameter of the casing conduit.

FIGS. 1-12 provide illustrative, non-exclusive examples of hydrocarbon wells 20, casing strings 30, flow control assemblies 100, and/or components thereof that may be included in and/or utilized with the systems and methods according to the present disclosure. With this in mind, the following are additional illustrative, non-exclusive examples of components of flow control assemblies 100 according to the present disclosure that may be included in and/or utilized with any of the structures of any of FIGS. 1-12.

Injection conduits 114 may be any suitable fluid conduit that is defined by housing 110, housing body 112, and/or ball sealer seat 116, that is configured to permit fluid flow therethrough when the ball sealer is not present on the ball sealer seat, and that is configured to restrict fluid flow from the casing conduit therethrough when the ball sealer is located on the ball sealer seat. As discussed, the systems and methods disclosed herein may include stimulating a subterranean formation by flowing a stimulant fluid through the injection conduit and into the subterranean formation. As such, a cross-sectional area of injection conduits 114 may be selected to permit and/or facilitate stimulation of the subterranean formation. This may include selecting the cross-sectional area of the injection conduits to maintain at least a threshold pressure drop thereacross when the stimulant fluid flows therethrough, to maintain a positive net pressure within the casing conduit when the stimulant fluid flows through the injection conduit, and/or to maintain at least a threshold stimulant fluid velocity when the stimulant fluid flows through the injection conduit. The threshold pressure drop and/or the positive net pressure may be selected to (or to be sufficient to) retain ball sealers on an occluded ball sealer seat during the stimulating (as illustrated in FIG. 4) and/or to retain a seated isolation ball on an occluded isolation ball seat during the stimulating (as illustrated in FIG. 6).

FIGS. 1-12 illustrate flow control assemblies 100 that include various numbers of injection conduits 114. However, it is within the scope of the present disclosure that the flow control assembly may include a single injection conduit 114 or a plurality of injection conduits 114 that may be at least partially defined by a single or a respective plurality of ball sealer seats 116. As illustrative, non-exclusive examples, flow control assemblies 100 may include at least 2, at least 4, at least 6, at least 8, at least 10, at least 12, at least 14, or at least 16 ball sealer seats and a corresponding number of injection conduits 114. Additionally or alternatively, flow control assemblies 100 also may include fewer than 24, fewer than 22, fewer than 20, fewer than 18, fewer than 16, fewer than 14, fewer than 12, fewer than 10, or fewer than 8 ball sealer seats and a corresponding number of injection conduits 114. When two or more ball sealer seats 116 are present in/on a flow control assembly 100, the seats may be spaced in any suitable relative spacing, including axially and/or radially around/along housing body 112. However, the seats should be spaced sufficiently from each other to permit effective locating and sealing of ball sealers on each of the seats so that fluid flow through all of the corresponding injection conduits is restricted or blocked.

When flow control assembly 100 includes a plurality of ball sealer seats 116, it is within the scope of the present disclosure that the plurality of ball sealer seats may define any suitable total flow area (or total cross-sectional area). As illustrative, non-exclusive examples, the total flow area may be at least 4 square centimeters, at least 6 square centimeters, at least 8 square centimeters, at least 10 square centimeters, at least 12 square centimeters, at least 14 square centimeters, at least 16 square centimeters, at least 18 square centimeters, at least 20 square centimeters, at least 22 square centimeters, at least 24 square centimeters, or at least 26 square centimeters. Additionally or alternatively, the total flow area also may be less than 60 square centimeters, less than 55 square centimeters, less than 50 square centimeters, less than 45 square centimeters, less than 40 square centimeters, less than 35 square centimeters, less than 30 square centimeters, less than 25 square centimeters, less than 20 square centimeters, less than 18 square centimeters, less than 16 square centimeters, less than 14 square centimeters, or less than 12 square centimeters.

When flow control assemblies 100 form a portion of casing strings 30 that include perforations 60, it is within the scope of the present disclosure that a cross-sectional area of injection conduits 114 (or of ball sealer seats 116) may be within a threshold percentage of a cross-sectional area of perforations 60. As discussed with reference to FIGS. 2-8, the systems and methods disclosed herein may include stimulating subterranean formation 28 by flowing stimulant fluid 62 through both perforations 60 and injection conduits 114. As such, matching the cross-sectional area of the injection conduits to the cross-sectional area of the perforations to within the threshold percentage may permit the use of equivalent, at least substantially equivalent, and/or similar flow rates of stimulant fluid 62 during stimulation of the subterranean formation via the perforations and the injection conduits. Illustrative, non-exclusive examples of threshold percentages according to the present disclosure include threshold percentages of less than 50%, less than 45%, less than 40%, less than 35%, less than 30%, less than 25%, less than 20%, less than 15%, less than 10%, or less than 5% of the cross-sectional area of the perforation.

Isolation ball seat 146 may include any suitable structure that may be included in and/or defined by sliding sleeve 140 and that may be configured to receive isolation ball 148 and to form a fluid seal therewith. As an illustrative, non-exclusive example, isolation ball seat 146 may include and/or be a machined isolation ball seat. As another illustrative, non-exclusive example, isolation ball seat 146 may define an isolation ball sealing surface that is configured to form the fluid seal with isolation ball 148. The isolation ball sealing surface may include any suitable property and/or may define any suitable shape and/or structure, illustrative, non-exclusive examples of which are discussed herein with reference to ball sealer sealing surface 117. As yet another illustrative, non-exclusive example, isolation ball seat 146 may be defined by any suitable portion of sliding sleeve 140, illustrative, non-exclusive examples of which include an uphole end of the sliding sleeve, a downhole end of the sliding sleeve, or a central portion of the sliding sleeve.

The illustrative, non-exclusive examples of hydrocarbon wells 20, casing strings 30, and/or flow control assemblies 100 that are disclosed herein have been discussed in the context of a ball sealer that is configured to seal a ball sealer seat that is defined by flow control assembly 100. However, it is within the scope of the present disclosure that flow control assemblies 100 may be utilized with any suitable sealing structure that may be configured to selectively permit and/or restrict fluid flow through injection conduits 114. With this in mind, ball sealer seat 116 also may be and/or may be referred to herein as a sealing seat 116, a sealing surface 116, a designated sealing surface 116, a designed sealing surface 116, a sealing body receptacle 116, a sealing device receptacle 116, a sealing unit receptacle 116, and/or a sealing structure receptacle 116. Similarly, ball sealer 118 also may be referred to herein as and/or may be a sealing device 118, a sealing unit 118, a sealing body 118, and/or a sealing structure 118.

In addition, the illustrative, non-exclusive examples disclosed herein also have been discussed in the context of an isolation ball that is configured to seal an isolation ball seat. However, it is within the scope of the present disclosure that flow control assemblies 100 may be utilized with any suitable sealing structure that may be configured to selectively permit and/or restrict fluid flow through housing conduit 120. With this in mind, isolation ball seat 146 also may be referred to herein as and/or may be an isolation seat 146, an isolation surface 146, a designated isolation surface 146, a designed isolation surface 146, an isolation body receptacle 146, an isolation device receptacle 146, and/or an isolation structure receptacle 116. Similarly, isolation ball 148 also may be referred to herein as and/or may be an isolation device 148, an isolation unit 148, an isolation body 148, and/or an isolation structure 148.

Figure 13:
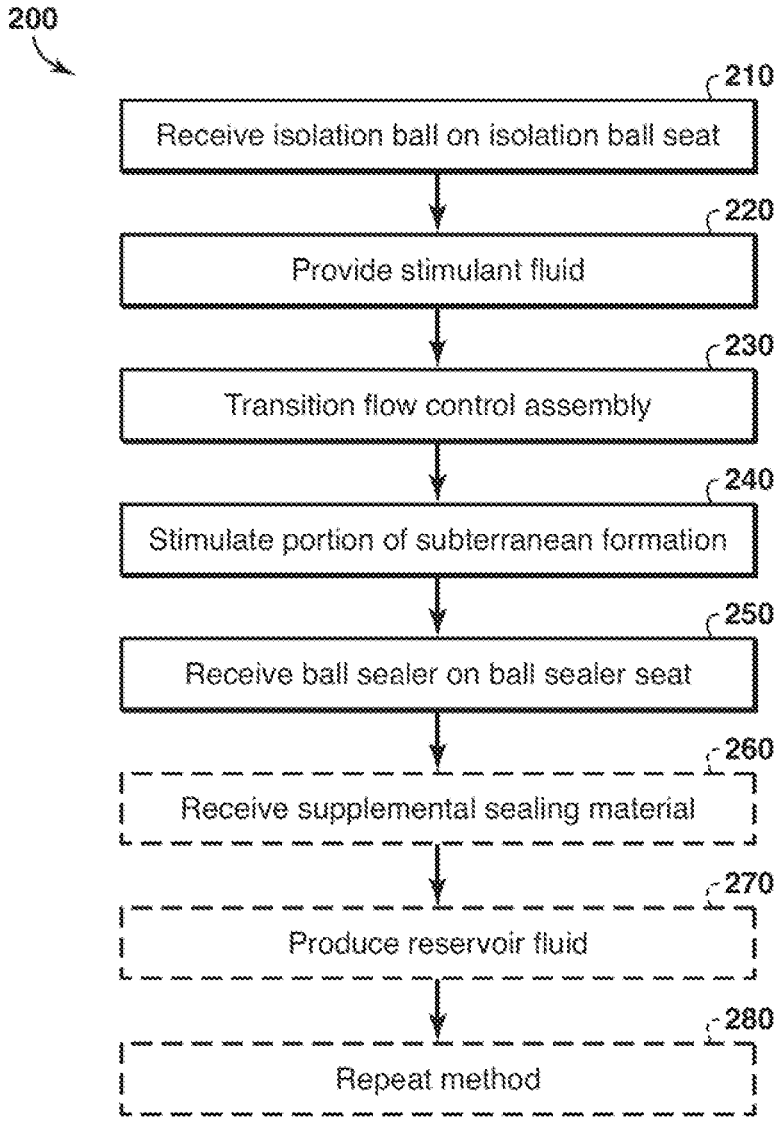
FIG. 13 is a flowchart depicting methods according to the present disclosure of stimulating a subterranean formation.

FIG. 13 is a flowchart depicting methods 200 according to the present disclosure of stimulating a subterranean formation. Methods 200 include receiving an isolation ball on an isolation ball seat of a flow control assembly at 210, providing a stimulant fluid at 220, transitioning the flow control assembly at 230, stimulating a portion of a subterranean formation at 240, and receiving a ball sealer on a ball sealer seat of the flow control assembly at 250. Methods 200 further may include receiving a supplemental sealing material at 260, producing a reservoir fluid from the subterranean formation at 270, and/or repeating at least a portion of the methods at 280.

Receiving the isolation ball on the isolation ball seat at 210 may include receiving any suitable isolation ball on any suitable isolation ball seat that is defined by the flow control assembly. This may include forming a fluid seal between the isolation ball and the isolation ball seat, fluidly isolating an uphole portion of a casing conduit from a downhole portion of the casing conduit, and/or fluidly isolating the uphole portion of the casing conduit from the subterranean formation.

As discussed herein, the casing conduit may be defined by a casing string that includes the flow control assembly and a plurality of lengths of casing. As also discussed herein, the casing string may form a portion of a hydrocarbon well and may extend within a wellbore and between a surface region and the subterranean formation. As such, the receiving at 210 may include providing the isolation ball from the surface region and/or from an uphole portion of the casing conduit and flowing the isolation ball into contact with the isolation ball seat to receive, or locate, the isolation ball on the isolation ball seat. As an illustrative, non-exclusive example, the flowing may include flowing the isolation ball with the stimulant fluid and/or flowing the isolation ball during the providing at 220.

Providing the stimulant fluid at 220 may include providing the stimulant fluid to the uphole portion of the casing conduit. This may include providing the stimulant fluid to increase a pressure within the uphole portion of the casing conduit, to maintain a positive net pressure within the casing conduit, and/or to create, generate, and/or provide a motive force for generation of a pressure differential across the isolation ball. As an illustrative, non-exclusive example, the providing at 220 may include pumping the stimulant fluid into the uphole portion of the casing conduit, such as from the surface region. It is within the scope of the present disclosure that the stimulant fluid may include and/or be any suitable fluid and/or fluid-containing stream. As illustrative, non-exclusive examples, the stimulant fluid may include and/or be water, a foam, an acid, and/or a proppant.

As discussed herein with reference to the receiving at 210, at least a portion of the providing at 220 may be concurrent with the receiving at 210. However, it is also within the scope of the present disclosure that at least a portion of the providing at 220 may be subsequent to the receiving at 210. In addition, and as also discussed herein, the providing at 220 also may include retaining a seated ball sealer on an occluded ball sealer seat, such as by generating a pressure differential between the casing conduit and the subterranean formation and/or retaining a seated isolation ball on an occluded isolation ball seat with the pressure differential across the isolation ball that is generated by the providing.

It is within the scope of the present disclosure that the providing at 220 may include providing during any suitable portion of methods 200. As an illustrative, non-exclusive example, the providing at 220 may include continuously, or at least substantially continuously, providing the stimulant fluid during methods 200. As additional illustrative, non-exclusive examples, the providing at 220 also may include providing during at least 75%, at least 80%, at least 85%, at least 90%, at least 95%, at least 97.5%, at least 99%, or 100% of a time period during which methods 200 are performed.

Transitioning the flow control assembly at 230 may be subsequent to the receiving at 210 and/or subsequent to the providing at 220 and may include transitioning the flow control assembly responsive to receipt of the isolation ball by the sliding sleeve, responsive to receipt of the isolation ball by the isolation ball seat, and/or responsive to the pressure differential across the isolation ball exceeding, or increasing above, a threshold pressure differential after the isolation ball has been received by the sliding sleeve. As discussed herein, the transitioning may include transitioning from a first configuration, in which the uphole portion of the casing conduit is fluidly isolated from the subterranean formation, to a second configuration, in which an injection conduit of the flow control assembly provides fluid communication between the casing conduit and the subterranean formation.

As an illustrative, non-exclusive example, and as discussed, the flow control assembly may include a sliding sleeve, and the transitioning at 230 may include translating the sliding sleeve within the flow control assembly to transition the flow control assembly from the first configuration to the second configuration. This may include translating the sliding sleeve in a downhole direction and/or translating the sliding sleeve along a longitudinal axis of the casing string and/or of the casing conduit. As another illustrative, non-exclusive example, and as discussed, the flow control assembly may include at least one shear pin that may retain the sliding sleeve in the first configuration and the transitioning at 230 may include shearing the shear pin(s).

Stimulating the portion of the subterranean formation at 240 may be subsequent to the receiving at 210, the providing at 220, and/or subsequent to the transitioning at 230 and may include flowing a portion of the stimulant fluid through the injection conduit and into the subterranean formation as an injection conduit fluid flow. It is within the scope of the present disclosure that the stimulating may include stimulating the subterranean formation in any suitable manner. As illustrative, non-exclusive examples, the stimulating at 240 may include fracturing the portion of the subterranean formation, dissolving a fraction of the portion of the subterranean formation, and/or increasing a fluid permeability of the portion of the subterranean formation.

Receiving the ball sealer on the ball sealer seat at 250 may be performed subsequent to the receiving at 210, subsequent to the providing at 220, subsequent to the transitioning at 230, and/or subsequent to the stimulating at 240 and may include receiving any suitable ball sealer on any suitable ball sealer seat. The receiving at 250 may include receiving to form a fluid seal between the ball sealer and the ball sealer seat, to fluidly isolate the uphole portion of the casing conduit from the subterranean formation, and/or to restrict fluid flow from the casing conduit and through the injection conduit.

Similar to the receiving at 210, the receiving at 250 may include providing the ball sealer to the uphole portion of the casing conduit and flowing the ball sealer into contact with the ball sealer seat. This may include flowing with the stimulant fluid and/or flowing during the providing at 220.

Optionally receiving the supplemental sealing material at 260 may include receiving any suitable supplemental sealing material with the flow control assembly and/or locating the supplemental sealing material proximal to, in contact with, in mechanical contact with, and/or in physical contact with the ball sealer, the ball sealer seat, the isolation ball, and/or the isolation ball seat. This may include receiving to decrease a fluid flow past the ball sealer seat (i.e., through the injection conduit) and/or to decrease a fluid flow past the isolation ball seat. Illustrative, non-exclusive examples of supplemental sealing materials are disclosed herein.

Optionally producing the reservoir fluid from the subterranean formation at 270 may include producing any suitable reservoir fluid that may be present within the subterranean formation, such as a hydrocarbon fluid, and may be performed subsequent to the stimulating at 240. It is within the scope of the present disclosure that the producing at 270 may include producing with, through, via, and/or using the flow control assembly, the casing string, and/or the hydrocarbon well. It is also within the scope of the present disclosure that methods 200 may include performing methods 200 without setting a bridge plug within the casing conduit and/or that the producing at 270 may include transitioning from the stimulating at 240 to the producing at 270 without removing a bridge plug from the casing conduit.

The producing may include flowing the reservoir fluid from the subterranean formation, through the injection conduit into the casing conduit and/or through a perforation that may be defined within the casing string into the casing conduit, through the casing conduit, and to the surface region. This may include removing the isolation ball and/or the ball sealer from the casing conduit by flowing the isolation ball and/or the ball sealer within, or with, the reservoir fluid to the surface region.

Optionally repeating at least a portion of the method at 280 may include repeating any suitable portion of methods 200. As an illustrative, non-exclusive example, and subsequent to the producing at 270, it may be desirable to re-stimulate at least a portion of the subterranean formation, and the repeating at 270 may include this re-stimulation.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of stimulating a subterranean formation, the method comprising:

receiving an isolation ball on an isolation ball seat of a flow control assembly to fluidly isolate an uphole portion of a casing conduit from a downhole portion of the casing conduit;

providing a stimulant fluid to the uphole portion of the casing conduit to increase a pressure within the uphole portion of the casing conduit;

transitioning the flow control assembly from a first configuration to a second configuration responsive to a pressure differential across the isolation ball increasing above a threshold pressure differential, wherein, in the first configuration, the uphole portion of the casing conduit is fluidly isolated from the subterranean formation, and further wherein, in the second configuration an injection conduit of the flow control assembly provides fluid communication between the uphole portion of the casing conduit and the subterranean formation;

stimulating a portion of the subterranean formation by flowing a portion of the stimulant fluid through the injection conduit and into the subterranean formation as an injection conduit fluid flow;

receiving a ball sealer on a ball sealer seat that defines a portion of the injection conduit to restrict the injection conduit fluid flow through the injection conduit; and producing a reservoir fluid from the subterranean formation subsequent to the stimulating by removing the isolation ball and the ball sealer from the casing conduit and flowing the isolation ball and the ball sealer within the reservoir fluid and to a surface region.

2. The method of claim 1, wherein the receiving the isolation ball includes providing the isolation ball to the uphole portion of the casing conduit and flowing the isolation ball into contact with the isolation ball seat.

3. The method of claim 1, wherein the providing a stimulant fluid includes at least one of:

(i) retaining a seated ball sealer on an occluded ball sealer seat with a pressure differential between the casing conduit and the subterranean formation that is generated by the providing a stimulant fluid; and (ii) retaining a seated isolation ball on an occluded isolation ball seat with the pressure differential across the isolation ball that is generated by the providing a stimulant fluid.

4. The method of claim 1, wherein the flow control assembly includes a sliding sleeve, wherein in the first configuration, the sliding sleeve resists an injection conduit fluid flow through the injection conduit, wherein, in the second configuration, the sliding sleeve permits the injection conduit fluid flow, and further wherein the transitioning includes translating the sliding sleeve to transition the flow control assembly from the first configuration to the second configuration.

5. The method of claim 1, wherein the receiving the ball sealer includes providing the ball sealer to the uphole portion of the casing conduit and flowing the ball sealer into contact with the ball sealer seat.

6. The method of claim 1, wherein the providing the stimulant fluid includes continuously, or at least substantially continuously, providing the stimulant fluid during the method.

7. A flow control assembly that is configured to control a fluid flow within a casing conduit of a casing string that extends within a subterranean formation, the assembly comprising:

a housing that includes:

a housing body that defines at least a portion of an outer surface of the housing and at least a portion of an opposed inner surface of the housing, wherein the inner surface defines a housing conduit that forms a portion of the casing conduit;

an injection conduit that extends through the housing body between the housing conduit and the subterranean formation; and a ball sealer seat that defines a portion of the injection conduit, is defined on the inner surface of the housing, and is sized to receive a ball sealer to restrict fluid flow from the casing conduit through the injection conduit;

a sliding sleeve that is located within the housing conduit and is configured to transition between a first configuration, in which the sliding sleeve resists an injection conduit fluid flow through the injection conduit, and a second configuration, in which the sliding sleeve permits the injection conduit fluid flow through the injection conduit, wherein the sliding sleeve includes an isolation ball seat that is configured to receive an isolation ball to restrict fluid flow from a portion of the casing conduit that is uphole from the flow control assembly to a portion of the casing conduit that is downhole from the flow control assembly; and a retention structure that is configured to retain the sliding sleeve in the first configuration and to selectively permit the sliding sleeve to transition from the first configuration to the second configuration when the isolation ball is located on the isolation ball seat and a pressure differential across the isolation ball is greater than a threshold pressure differential, the ball sealer and the isolation ball being flowable for flowing out of the wellbore subsequent to stimulating a portion of the subterranean formation, when the wellbore is produced.

8. The assembly of claim 7, wherein the injection conduit is a first injection conduit, wherein the ball sealer seat is a first ball sealer seat, and further wherein the housing includes a plurality of injection conduits and a plurality of respective ball sealer seats.

9. The assembly of claim 7, wherein the ball sealer seat defines a ball sealer sealing surface that is configured to form a fluid seal with the ball sealer, wherein the ball sealer sealing surface is an at least substantially circular ball sealer sealing surface.

10. The assembly of claim 7, wherein the ball sealer seat is a machined ball sealer seat.

11. The assembly of claim 7, wherein the ball sealer seat is defined by at least one of:

(i) the housing body;

(ii) a coating that is operatively attached to the housing body;

(iii) a surface treatment of the housing body; and (iv) an insert that is operatively attached to the housing body.

12. The assembly of claim 7, wherein a material composition of the ball sealer seat is different from a material composition of the housing body.

13. The assembly of claim 7, wherein the ball sealer seat includes at least one of an erosion-resistant ball sealer seat, a corrosion-resistant ball sealer seat, a hardened ball sealer seat, a resilient ball sealer seat, an elastomeric ball sealer seat, and a compliant ball sealer seat.

14. The assembly of claim 7, wherein the ball sealer seat is defined on at least one of a chamfered surface, a tapered surface, and a rounded surface.

15. The assembly of claim 7, wherein, when the isolation ball is located on the isolation ball seat and the sliding sleeve is in the second configuration, the isolation ball and the ball sealer seat define a minimum clearance therebetween.

16. The assembly of claim 15, wherein the minimum clearance is sized to permit sealing of the ball sealer seat by the ball sealer without contact between the ball sealer and the isolation ball.

17. The assembly of claim 15, wherein the flow control assembly further includes the isolation ball, and further wherein the isolation ball is located on the isolation ball seat.

18. The assembly of claim 15, wherein the flow control assembly further includes the ball sealer, and further wherein the ball sealer is located on the ball sealer seat.

19. A casing string that defines a casing conduit, the casing string comprising:

a first length of casing that defines a first portion of the casing conduit;

a second length of casing that defines a second portion of the casing conduit; and the flow control assembly of claim 7, wherein the flow control assembly is located between and selectively fluidly isolates the first portion of the casing conduit from the second portion of the casing conduit.

20. A hydrocarbon well, comprising:

a wellbore that extends between a surface region and a subterranean formation; and a casing string that extends within the wellbore, wherein the casing string includes the casing string of claim 19.

21. The hydrocarbon well of claim 20, wherein the hydrocarbon well further includes the isolation ball and the ball sealer, wherein the isolation ball is received on the isolation ball seat, wherein the sliding sleeve is in the second configuration, and further wherein the ball sealer is received on the ball sealer seat.

22. The hydrocarbon well of claim 21, wherein the flow control assembly resists a housing conduit fluid flow through the housing conduit in a downhole direction.

23. The hydrocarbon well of claim 21, wherein the flow control assembly resists the injection conduit fluid flow from the casing conduit, through the injection conduit, and into the subterranean formation.

* * * * *